US005399101A

United States Patent [19]

Campbell et al.

[11] Patent Number: 5,399,101

[45] Date of Patent: Mar. 21, 1995

[54] ELECTRICAL CONNECTOR WITH PRELOADED CONTACT

[75] Inventors: Jeffrey S. Campbell, Binghamton; Thomas G. Macek, Endicott, both of N.Y.

[73] Assignee: International Business Machines Corporation, Armonk, N.Y.

[21] Appl. No.: 168,749

[22] Filed: Dec. 16, 1993

[51] Int. Cl.[6] ..... H01R 11/18

[52] U.S. Cl. ..... 439/482; 439/886

[58] Field of Search ..... 439/55, 65–66, 439/74–75, 482, 886; 324/72.5, 158 F, 158 P

[56] References Cited

U.S. PATENT DOCUMENTS

| | | | |
|---|---|---|---|
| 3,961,834 | 6/1976 | Venaleck et al. . | |
| 4,526,436 | 7/1985 | Aso | 330/176 |
| 4,734,053 | 3/1988 | Imai | 439/329 |
| 4,871,315 | 10/1989 | Noschese | 439/67 |
| 4,948,379 | 8/1990 | Evans | 439/329 |
| 5,033,977 | 7/1991 | Ignasiak | 439/482 |
| 5,106,311 | 4/1992 | Yodogawa et al. | 439/77 |
| 5,181,854 | 1/1993 | Masuda | 439/67 |
| 5,185,073 | 2/1993 | Bindra et al. | 205/104 |
| 5,199,882 | 4/1993 | Bates et al. | 439/67 |
| 5,215,471 | 6/1993 | Reymond et al. | 439/66 |
| 5,237,743 | 8/1993 | Busacco et al. | 29/885 |
| 5,248,262 | 9/1993 | Busacco et al. | 439/66 |
| 5,320,559 | 6/1994 | Uratsuji et al. | 439/482 |

FOREIGN PATENT DOCUMENTS 1121011 3/1982 Canada .

*Primary Examiner*—Khiem Nguyen

*Attorney, Agent, or Firm*—Lawrence R. Fraley

[57] ABSTRACT

An electrical connector for being electrically coupled to at least one electrical conductor. The connector includes a housing and at least one contact positioned therein and including a tip portion which protrudes from the housing to engage the conductor. Significantly, the contact, initially of a non-stressed configuration, is preloaded within the housing to assume a curved configuration and to engage the respective conductor in such a manner that sound, positive engagement occurs in a substantially non-wiping manner. The housing may thus be stationarily positioned relative to the circuit member, the circuit member able to thus press against the tip portion of the contact to complete coupling. The remaining part of the invention may be electrically coupled to an external conductor, e.g., a cable.

12 Claims, 2 Drawing Sheets

ELECTRICAL CONNECTOR WITH PRELOADED CONTACT

TECHNICAL FIELD

The invention relates to electrical connectors and particularly to such connectors for use in information handling systems (computers).

BACKGROUND OF THE INVENTION

As is understood, several types of electrical connectors are known in the art. In U.S. Pat. No. 3,961,834 (Venaleck), there is described a bow contact for being slidably engaged along a bowed, side surface thereof by a conductor, e.g., connector pin. Such engagement serves to compress the preformed bowed configuration. In U.S. Pat. No. 4,526,436 (Aso), there is described an electrical connector for connecting to a flexible, multi-connector cable when the cable is inserted therein.

In U.S. Pat. No. 4,734,053 (Imai), another type of flat cable connector is disclosed, this connector using two housing parts which mate together to compress the cable. In U.S. Pat. No. 4,871,315 (Noschese), there is described yet another cable connector, this for what is defined as a ribbon cable, the cable of different layers each of which is associated with a respective subassembly (cable holder lock). U.S. Pat. No. 4,948,379 (Evans) describes yet another version of a connector for connecting what are referred to as circuit-bearing substrates positioned therein, the connections being made to respective contacts located within the connector's housing. U.S. Pat. Nos. 5,106,311 (Yodogawa et al.), 5,181,854 (Masuda) and 5,199,882 (Bates et al. ) all describe various types of electrical connectors for having flexible or the like cables positioned therein to effect contact therewith in a predetermined manner. In U.S. Pat. No. 5,215,471 (Raymond et al.), an electrical connector is described wherein tapered plugs or the like are individually positioned within respective receiving portions of the connector's housing.

In U.S. Pat. No. 5,237,743 (Busacco et al.), there is defined a method of forming a conductive end portion on a flexible circuit member for use in an electrical connector, wherein the end portion is adaptive for including dendritic conductive elements (e.g., palladium) on a protruding edge thereof for electrically connecting to associated conductor members (e.g., pads on a printed circuit board or electronic module). As defined in U.S. Pat. No. 5,237,743, the preferred method for providing these dendritic elements is electroplating, which may be provided in accordance with the procedure defined in Canadian patent 1,121,011. Still another process is defined in U.S. Pat. No. 5,185,073 (Bindra et al.). U.S. Pat. Nos. 5,185,073 and 5,237,743, in addition to Canadian patent 1,121,011, are all assigned to the assignee of the present invention and are incorporated herein by reference.

In U.S. Pat. No. 5,248,262 (Busacco et al.), there is defined yet another electrical connector for interconnecting a pair of circuit members (e.g., a printed circuit board and electronic module) wherein, in one embodiment, the housing designed for having the connector's contact members therein is specifically designed for occupying first and second positions with respect to the interconnected circuit members during compression thereof against the interim connector in U.S. Pat. No. 5,248,262. Movement of the interim housing in this embodiment serves to prevent wipe of the end portions of the electrical contacts during such compression, said wiping not desired in at least one aspect of this invention (e.g., when using the aforementioned dendritic contact elements as part of the contact structure). Understandably, the connector in U.S. Pat. No. 5,248,262 may utilize the dendritic elements formed in accordance with the unique method taught in U.S. Pat. No. 5,237,743. U.S. Pat. No. 5,248,262 is assigned to the same assignee as the present invention and is also incorporated herein by reference.

In accordance to the teachings herein, there is defined an electrical connector for electrically connecting at least one external electrical conductor (e.g., a conductor pad on a printed circuit board) to a second conducting element such as an electrical cable or the like, which second element may be positioned within the invention's housing. Significantly, the connector as defined herein provides such connecting to this external conductor in a substantially non-wiping manner while assuring stationary positioning of the connector's housing relative to the conductor being so connected, or, alternatively, fixed positioning of the external conductor and movement of the connector with respect thereto. Such stationary positioning eliminates the need for added structure to permit housing movement while still assuring effective coupling to the respective conductor.

It is believed that an electrical connector possessing the above advantageous features and other features discernable from the teaching herein would constitute a significant advancement in the art.

DISCLOSURE OF THE INVENTION

It is, therefore, a primary object of the present invention to enhance the electrical connector art.

It is another object of the invention to provide an electrical connector capable of providing a substantially non-wiping type of engagement between a contact thereof and an external electrical conductor such that dendritic or the like contact elements may be used on an end portion of this contact to in turn provide the significant advantages of such elements (e.g., penetration of dust, films and fibrous debris ).

It is yet another object of the invention to provide such a connector which is of relatively simple design and which can be produced in a relatively inexpensive manner.

In accordance with one aspect of the invention, there is provided an electrical connector for being electrically coupled to at least one electrical conductor. The connector comprises a housing having a chamber therein, and at least one electrical contact positioned within the housing and including a tip portion protruding from the housing for engaging the electrical conductor. Significantly, the contact includes an initial overall first length and corresponding first width prior to being positioned within the housing. When so positioned, and prior to engagement with the electrical conductor, the housing engages the contact at three spaced locations so as to preload the contact to the extent that it will possess a second length and corresponding second width, this second width, significantly, being greater than the first width prior to contact positioning. When contact occurs between the protruding tip and associated electrical conductor, the contact is disengaged at at least one part thereof and moved to a different location so as to accommodate the compressive forces provided during conductor engagement while still substantially preventing sliding (wiping) type of engagement between the protruding tip and conductor.

BEST MODE FOR CARRYING OUT THE INVENTION

For a better understanding of the present invention, together with other and further objects, advantages and capabilities thereof, reference is made to the following disclosure and appended claims in connection with the above-described drawings.

As will be defined herein, the present invention represents a buckling beam type of contact which is preloaded within the connector's housing to create a geometric condition which greatly reduces the forces exerted on the contact by the connector's housing during contact compression (engagement with the associated external conductor). The forces exerted on the contact by the housing are low enough such that, due to friction, sliding (wiping) will be substantially prevented at the contact's tip portion and external conductor interface. By the term substantially prevented is thus meant to include a condition whereby very minimal movement, as defined, e.g., in greater detail hereinbelow, may still cocur. Such minimal movement, however, is allowable while still permitting effective connection in the manner taught herein. Accordingly, the invention does not require a movable connector housing to assure a substantially non-sliding type of electrical connection. The invention is thus able to utilize the aforedefined dendritic contact elements on the tip portion of the invention's contact to thereby benefit from the established advantages of such elements, while not causing harm to these elements. It is understood, however, that the connector of the invention does not require the use of such dendritic contact elements, in that the invention's contact may still provide effective connection (including of the substantially non-sliding type) with the associated external conductor in an effective manner without the use of such elements. The invention is thus not limited solely to the use of dendritic elements as part of the contact structure.

Figure 1:
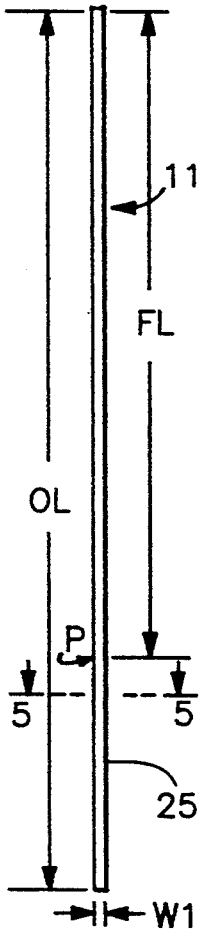
FIG. 1 is a side elevational view of an electrical contact for use in the invention, the contact shown as having a free (non-stressed) length.

In FIG. 1, there is shown an electrical contact 11 adapted for use in the present invention. Specifically, contact 11 is designed for being positioned within a housing 13 (FIGS. 2 and 3) to define an electrical connector 15 in accordance with the teaching hereof. Although only one such contact is shown in the drawings, it is understood that housing 13 is readily adapted for having several (e.g., up to fifty and more ) such contacts therein, depending on the operational requirements for the invention. In a preferred embodiment, connector 15 will include several such contacts spacedly positioned within the housing in accordance with an established patterned array. Such a pattern may be rectangular having the aforementioned total contacts located in spaced rows thereof. Should several such contacts be used, it is preferred that these be spacedly positioned from the nearest adjacent contact at a minimum distance of about 0.050 inch.

Contact 11 is shown in FIG. 1 prior to positioning within housing 13, and, as illustrated, in a non-stressed configuration. That is, contact 11 is not preformed with a bowed or other curved shape or the like, particularly along the contacting portions thereof. As understood from the teachings herein, housing 13 serves to provide preloading of the contact 11 when so positioned therein in order to provide the significant advantages defined herein.

Figure 2:
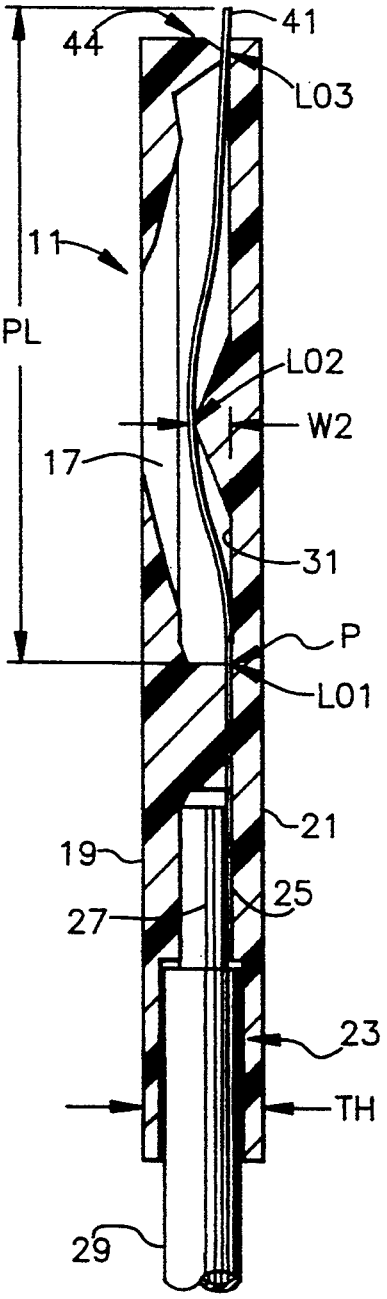
FIG. 2 is a side elevational view, partly in section, of an electrical connector in accordance with one embodiment of the invention, the connector shown with its contact in a preloaded orientation prior to engagement with an electrical conductor.
Figure 3:
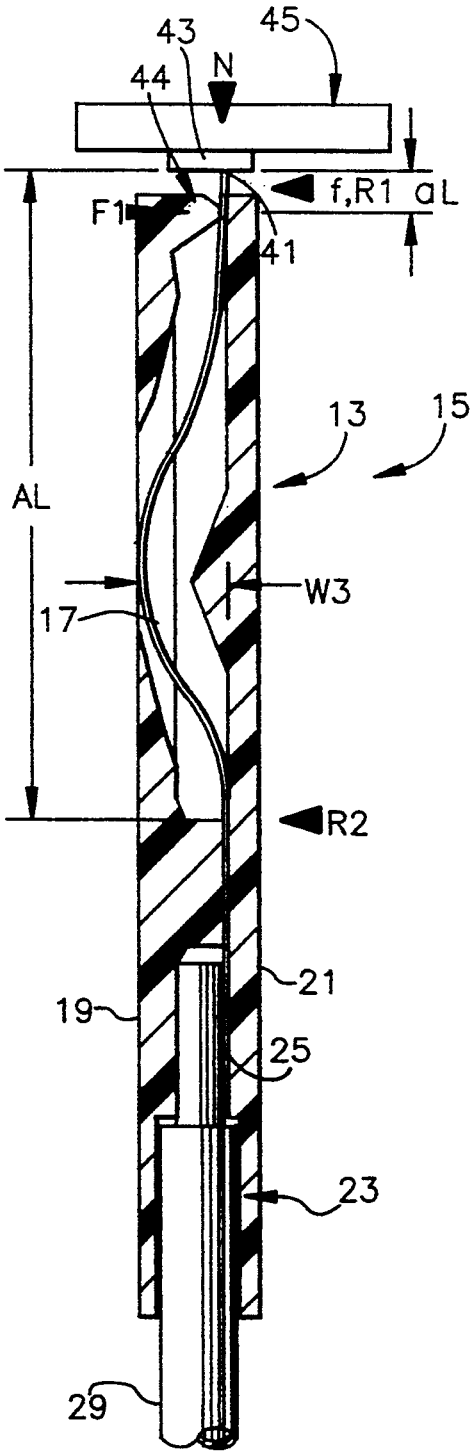
FIG. 3 is a side elevational view of the connector of FIG. 2 engaging an electrical conductor.

In FIG. 1, contact 11 has an original, unstressed overall length (OL), which, in one embodiment of the invention, was about 0.400 inch. Of this total, overall length, contact 11 includes what is referred to as a free length (FL) which, as understood from FIGS. 2 and 3, represents the portion of contact 11 particularly designed for movement during contact engagement and housing preload. Thus, the remaining length of contact 11, as shown in FIGS. 2 and 3, is securely retained (captured) by the housing as shown. Such retention occurs below the location identified by the letter P in FIGS. 1 and 2.

Figure 5:
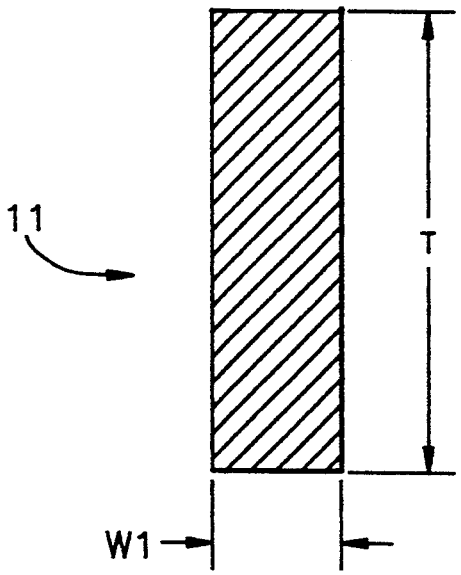
FIG. 5 is a sectional view on an enlarged scale, of the contact of FIG. 1 as taken along the line 5—5 in FIG. 1.

As shown in FIGS. 1 and 5, contact 11 includes a first width (W1) which represents the overall total width for the contact in the unstressed position prior to positioning with housing 13.

As also seen in FIG. 5, contact 11 has a thickness (dimension T) and is of a substantially rectangular cross-sectional configuration. In one embodiment of the invention, contact 11 possessed a first width (W1) of about 0.003 inch and corresponding thickness (T) of about 0.025 inch. Contact 11 is preferably comprised of metallic material, a preferred example being beryllium copper. The above configuration (rectangular) is not meant to limit the invention in that other configurations (including, e.g., round) are acceptable.

As seen in FIG. 2, contact 11 is positioned within housing 13 and retained from the portion of the contact below point P by the lowermost part of housing 13. The remaining portion (originally of the free length (FL)) projects within the chamber (or cavity) 17 defined by the upper portion of housing 13. Chamber 17 extends substantially the entire length of the housing's upper portion. In an preferred embodiment, housing 13 is of two-part construction, these parts referenced by the numerals 19 and 21 in the drawings. Both parts 19 and 21 are sealed together to compress the lower part of contact 11 in the manner shown.

Retained within the lower part of housing 11 is a cable 23, designed for being electrically connected to the lower end portion 25 of contact 11. Cable 23 preferably includes a terminal end 27 which is directly coupled (e.g., soldered or welded) to end portion 25, this coupling preferably occurring prior to closure of parts 19 and 21. Cable 23 further includes a sheath portion 29 of a suitable dielectric material, e.g., Teflon, which extends from the lower part of housing 13 in the manner shown. (Teflon is a trademark of E. I. dupont deNemours and Company.) In one embodiment, the terminal end 27 was preferably of cylindrical configuration, having an outer diameter of about 0.010 inch, while sheath portion 29 was also cylindrical and possessed an outer diameter of about 0.035 inch.

Contact 11 is shown in the embodiment of FIG. 2 as being in a preloaded or prestressed condition, such preloading being the result of positive engagement of the contact by housing 13 at least at three locations (L01, L02 and L03). L01 is understood to be similar to point P, L02 representing a tapered protrusion from the back wall 31 of housing 13, and L03 being a reverse (or opposing) pointed portion on the uppermost end of housing 13. In one embodiment, housing 13 possessed an overall thickness (TH, in FIG. 2) of about 0.050 inch. The corresponding overall length for this housing having such width was about 0.575 inch.

As seen in FIG. 2, the preloaded contact 11 is configured as a result of housing engagement in the manner defined to assume a bent or curved configuration for the upper part thereof. That is, the original free length (FL), as described in FIG. 1, has been reduced somewhat to what is referred to as a preload length (PL) (FIG. 2). In one embodiment of the invention, the preload length (PL) was about 0.275 inch from a corresponding free length of about 0.280 inch. A reduction of about 0.4 to about 5.4 percent may occur when using contact and housing members possessing the dimensions cited herein. A preferred reduction of 1.8 percent will occur. Significantly, the overall width (W1) for contact 11 has now been increased to a greater width (W2) which, significantly, constitutes only a relatively small percentage of the free length (FL). It has been determined that in order to provide the desired properties herein (substantially non-wiping, effective engagement) that a second width in the range of about 3.5 percent to about 13 percent of this free length is desired. In a preferred embodiment, this percentage is about 7.0 percent. Thus, W2, the new width for contact 11 while in a preloaded, yet non-engaging orientation with an external conductor, is within the range of about 0.010 inch to about 0.036 inch.

In a preferred embodiment, housing 13 is comprised of a dielectric material, a preferred example being Ryton (PPS). (Rayton is a trademark of Phillips Petroleum Company.) It is understood that other plastic materials are readily adaptable for use with the present invention.

In a preferred embodiment, the spacings between engagement locations L01 and L02 and L02 and L03 are the same, e.g., 0.125 inch. This is not meant to limit the invention, however, in that other spacings, including those wherein one distance is significantly greater than the other, are acceptable.

In FIG. 3, connector 15 is shown in an actuated position wherein contact is made between a tip portion 41 of contact 11 and an external conductor 43 on an external circuit member 45. It is understood that contact 11 is designed for being electrically coupled to many different types of electrical conductors. In one embodiment, conductor 43 may comprise a metallic (e.g., copper) flat pad on a circuit board or similar substrate. Significantly, tip portion 41 engages this conductor in the manner shown such that the terminal, edge portion of the invention's contact engages the corresponding surface of the external conductor at a relatively small angle to a normal line from this service. By the term a relatively small angle is meant that the terminal or tip portion 41 will engage the corresponding flat surface 47 (FIG. 4) at an angle of approximately no greater than 30 degrees, preferably at a lesser angle. Tip portion 41 thus engages conductor 43 with a predetermined force in response to a normal force (N) caused by downward (or compressive) movement of circuit member 45. It is understood that in the foregoing type of engagement, housing 13 is designed for remaining stationary relative to the movement of the associated electrical circuit member (45) such that this member can move toward and engage the protruding tip portion 41 of contact 11 in the manner shown. It is also within the scope of the invention to fixedly position the respective circuit member and move the connector housing (and contact 41) to effect engagement as shown. Preferably, however, housing 13 is positively retained, e.g., within a holder or the like, along with other, similar housings to assure contact between the large number (described above) of such contacts and a corresponding number of conductors.

When connector 15 is actuated, as shown in FIG. 3, the upper part of contact 11 is compressed even further from that shown in FIG. 2 to what is defined as an actuated length (AL). In one embodiment of the invention, AL was about 0.265 inch, or about 95 percent of the original free length (FL).

During connector actuation, the aforementioned normal force (N) is applied onto tip 41 as shown in FIG. 3. Additionally, a frictional force (f) is also present to resist sliding movement of tip portion 41 (e.g., to the right in FIG. 3). This force is counteracted by a housing engagement force (F1) exerted by an upper, tipped portion 44 of housing 13 at location LOS. F1 is shown in FIG. 3 as well, and occurs at a distance aL from a surface 47 (FIG. 4) of conductor 43.

Significantly, it is seen that contact 11 assumes a greater width (W3) in FIG. 3 from the preload width W2 of FIG. 2. In one example, W3 was as great as 0.040 inch, for an increase of as great as 1300 percent from the original width (W1).

Attention is now directed to the actuated connector in FIG. 3 and the various forces, distances, etc. shown therein. The significance of applying a preload (W2), in the range specified previously herein, prior to contact compression, is twofold. Firstly, it reduces the ratio (Z) of the reaction force R1 to the contact normal force N (e.g., Z=R1/N), where R1 is defined as the required transverse force applied to the contact tip to prevent sliding. Secondly, it reduces the amount of sliding that can occur if R1 is greater than f, where f is the maximum friction force that is available to resist sliding. It is understood that friction force f is equal to $\mu_s N$, where $\mu_s$ is defined as the coefficient of static friction. $\mu_s$ for a dendritic plated surface against a plated (e.g., with gold) surface is typically greater than 1. For this situation, if $RI<N$, sliding by tip 41 will not occur. For the same situation, an equivalent way of expressing this is, if Z is less than $\mu_s$, sliding will not occur. For the case where Z is greater than $\mu_s$, some sliding will occur, with the maximum amount of contact wipe occurring when $\mu_s$ approaches a value of zero.

In one embodiment of the invention, it was demonstrated, through the use of finite element modeling, that a 0.020 inch preload (e.g., W2=0.020 inches), in contrast to a 0.0 inch preload (e.g., W2=0.0 inches), significantly reduced the ratio Z. For example, a maximum value of Z equal to 1.4 was calculated for the higher preload case (e.g., W2=0.020 inches). This compares to a maximum value of Z equal to 2.7 for the lower preload case (e.g., W2=0.0 inches). It was also demonstrated that the potential for wipe was much lower for the higher preload case (e.g., W2=0.020 inches ). For this situation, it was determined that the maximum potential for wipe was 0.003 inches (when $\mu_s$ approaches zero). That is, the relative movement between the invention's tip portion and associated conductor can be as great as approximately 0.003 inch under such conditions without adversely affecting the invention's dendrites. For the lower preload case (e.g., W2=0.0 inches), it was determined that the maximum potential for wipe was 0.010 inches (when $\mu_s$ approaches zero ).

The performance benefits of increasing the preload (W2) are clearly evident based on the indicated results of the above finite element study. That is, increasing the preload (W2) reduces or eliminates wipe. Hence, from the standpoint of substantially preventing contact wipe, it is desirable to incorporate as high a preload (W2) as possible while concurrently satisfying all other requirements of the design.

As shown in FIG. 3, contact 11 has become disengaged from housing 13 at one location (L02) as a result of the above actuation. Housing 11 is designed in such a manner to facilitate such disengagement, while still assuring engagement at the remaining, opposing two locations L01 and L03.

Figure 4:
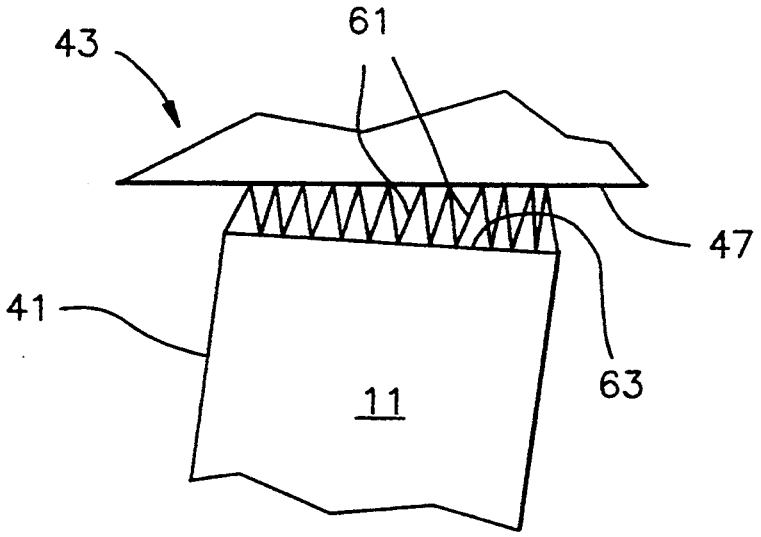
FIG. 4 is a much enlarged, partial view of one embodiment of a contact tip portion of the invention, including dendritic elements thereon, during engagement with an electrical conductor.

In FIG. 4, tip portion 41 of contact 11 is shown to include a plurality of dendritic elements 61 located on an upper, edge surface 63 of tip portion 41. As stated above, these dendritic elements are preferably metallic (e.g., palladium) growth crystals formed in accordance with known methods in the art, including, e.g., those defined in U.S. Pat. No. 5,185,073 and Canadian Patent 1,121,011. Again, these patents are incorporated herein by reference. It is also within the scope of the invention to provide similar dendritic elements on surface 47 of conductor 43, such that an intermesh of such elements will occur, thus providing an even more effective type of electrical connection.

Thus, there has been shown and described an electrical connector wherein at least one electrical contact is located therein which is capable of being preloaded as a result of positive engagement at predetermined locations along the contact such that contact between the contact's protruding tip portion and a respective electrical conductor will effectively occur in a substantially non-sliding (non-wiping) type of engagement, while still assuring that the housing may remain stationary with respect to the associated circuit member being engaged or, alternatively, the conductor remain stationary and the connector (with contact) moved thereto.

While they have been shown and described what are at present considered the preferred embodiments of the invention, it will be obvious to those skilled in the art that various changes and modifications may be made therein without departing from the scope of the invention as defined by the appended claims.

What is claimed is:

1. An electrical connector for being electrically coupled to at least one electrical conductor, said connector comprising:

a housing defining a chamber therein;

at least one electrical contact positioned within said housing and including a tip portion protruding from said housing and adapted for engaging said electrical conductor with a predetermined force and an opposing end portion securely positioned within said housing, said contact having an initial overall first length and corresponding first width prior to being positioned within said housing, said housing engaging said contact at three spaced locations on said contact so as to preload said contact within said housing such that said contact will possess a second length and corresponding second width, said second width greater than said first width and of an established, relatively small percentage of said overall first length, said housing being disengaged from said contact at one of said three spaced locations when said tip portion engages said electrical conductor to thereby substantially prevent a sliding type of engagement between said tip portion and said conductor.

2. The connector of claim 1 wherein said relatively small percentage is within the range of from about 3.5 percent to about 13.0 percent.

3. The connector of claim 2 wherein said relatively small percentage is about seven percent.

4. The connector of claim 1 wherein said second length of said contact is less that said first length by an established percentage when said housing engages said contact at said three locations so as to preload said contact within said housing.

5. The connector of claim 4 wherein said established percentage is within the range of about 0.4 percent to about 5.4 percent.

6. The connector of claim 5 wherein said established percentage is about 1.8 percent.

7. The connector of claim 1 wherein said contact possesses a substantially bowed configuration when engaged by said housing at said three locations.

8. The connector of claim 1 wherein one of said spaced locations of said contact engaged by said housing is substantially adjacent said tip portion.

9. The connector of claim 1 wherein said first length is the free length.

10. The connector of claim 1 further including an electrical cable, said contact being electrically coupled to said cable.

11. The connector of claim 1 wherein said tip portion of said contact includes a plurality of dendritic contacting elements thereon, said dendritic contacting elements adapted for engaging said electrical conductor to provide said electrical coupling.

12. An information handling system comprising:

a circuitized substrate including at least one electrical conductor; and an electrical connector for being electrically coupled to said electrical conductor, said connector including a housing defining a chamber therein, at least one electrical contact positioned within said housing and including a tip portion protruding from said housing and adapted for engaging said electrical conductor with a predetermined force and an opposing end portion securely positioned within said housing, said contact having an initial overall first length and corresponding first width prior to being positioned within said housing, said housing engaging said contact at three spaced locations on said contact so as to preload said contact within said housing such that said contact will possess a second length and corresponding second width, said second width greater than said first width and of an established, relatively small percentage of said overall first length, said housing being disengaged from said contact at one of said three spaced locations when said tip portion engages said electrical conductor to thereby substantially prevent a sliding type of engagement between said tip portion and said conductor.

* * * * *